US007141009B2

(12) United States Patent
Shifferaw

(10) Patent No.: US 7,141,009 B2
(45) Date of Patent: Nov. 28, 2006

(54) WEIGHTLIFTING SYSTEM FOR DOING LEG PRESSES

(76) Inventor: Tessema Dosho Shifferaw, 1019 Solano Ave., Albany, CA (US) 94706

( * ) Notice: Subject to any disclaimer, the term of this patent is extended or adjusted under 35 U.S.C. 154(b) by 180 days.

(21) Appl. No.: 11/048,428

(22) Filed: Feb. 1, 2005

(65) Prior Publication Data

US 2005/0192167 A1 Sep. 1, 2005

Related U.S. Application Data

(63) Continuation-in-part of application No. 10/600,216, filed on Jun. 19, 2003, now Pat. No. 7,018,325.

(51) Int. Cl.
*A63B 21/06* (2006.01)
*A63B 23/04* (2006.01)

(52) U.S. Cl. ..... 482/135; 482/95; 482/98

(58) Field of Classification Search ..... 482/79, 482/93–96, 98, 101, 104, 106, 135, 142, 482/145

See application file for complete search history.

(56) References Cited

U.S. PATENT DOCUMENTS

| | | | | |
|---|---|---|---|---|
| 560,517 | A | 5/1896 | Metzger | |
| 2,783,045 | A * | 2/1957 | Bosch | 482/96 |
| 3,235,255 | A * | 2/1966 | Leflar | 482/104 |
| 3,866,914 | A * | 2/1975 | Jackson | 473/438 |
| 4,205,838 | A | 6/1980 | McIntosh | |
| 4,502,681 | A | 3/1985 | Blomqvist | |
| 4,529,198 | A | 7/1985 | Hettick, Jr. | |
| 4,566,691 | A | 1/1986 | Mahnke | |
| 4,575,077 | A | 3/1986 | Osborne et al. | |
| 4,730,828 | A * | 3/1988 | Lane | 482/94 |
| 4,799,673 | A | 1/1989 | Selle | |
| 4,822,034 | A | 4/1989 | Shields | |
| 4,828,252 | A * | 5/1989 | Bowen et al. | 482/98 |
| 4,971,318 | A | 11/1990 | Tracy | |
| 5,060,939 | A | 10/1991 | Oswald et al. | |
| 5,116,297 | A | 5/1992 | Stonecipher | |
| 5,123,885 | A | 6/1992 | Shields | |
| 5,141,480 | A | 8/1992 | Lennox et al. | |
| 5,415,607 | A | 5/1995 | Carpenter | |
| 5,429,570 | A | 7/1995 | Beyer | |
| 5,462,510 | A | 10/1995 | Ish, III | |
| 5,630,776 | A | 5/1997 | Yang | |
| 5,827,154 | A * | 10/1998 | Gill | 482/9 |

(Continued)

FOREIGN PATENT DOCUMENTS

| | | | |
|---|---|---|---|
| JP | 8277983 | A | 10/1996 |

OTHER PUBLICATIONS

Yukon Fitness Equipment, TK-400 Caribou II Gym, 1994-95 Catalog.

*Primary Examiner*—Jerome Donnelly
*Assistant Examiner*—Victor K. Hwang
(74) *Attorney, Agent, or Firm*—Edward S. Wright

(57) ABSTRACT

Weightlifting system which is particularly suitable for doing leg presses having an inclined frame, a foot support near the lower end of the inclined frame for receiving the feet of an exerciser, a carriage adapted for receiving the back of the exerciser and being driven in an upward direction along the frame by extension of the legs of the exerciser, a weight bar extending laterally from each side of the carriage, a pair of weight stands positioned to the sides of the frame, and a plurality of weight plates disposed on each of the stands for selective attachment to the bar extending from each side of the carriage.

19 Claims, 6 Drawing Sheets

U.S. PATENT DOCUMENTS

| | | | | |
|---|---|---|---|---|
| 5,839,997 | A | 11/1998 | Roth et al. | |
| 6,033,350 | A | 3/2000 | Krull | |
| 6,039,678 | A | 3/2000 | Dawson | |
| 6,149,558 | A | 11/2000 | Chen | |
| 6,186,928 | B1 | 2/2001 | Chen | |
| 6,565,495 | B1 | 5/2003 | Slattery | |
| 6,682,464 | B1 | 1/2004 | Shifferaw | |
| 6,685,601 | B1 | 2/2004 | Knapp | |
| 6,811,521 | B1 * | 11/2004 | Musso | 482/104 |
| 7,004,891 | B1 * | 2/2006 | Morris et al. | 482/101 |
| 7,018,325 | B1 * | 3/2006 | Shifferaw | 482/104 |
| 2004/0023760 | A1 * | 2/2004 | Cockrill et al. | 482/93 |
| 2005/0192166 | A1 * | 9/2005 | Shifferaw | 482/94 |

* cited by examiner

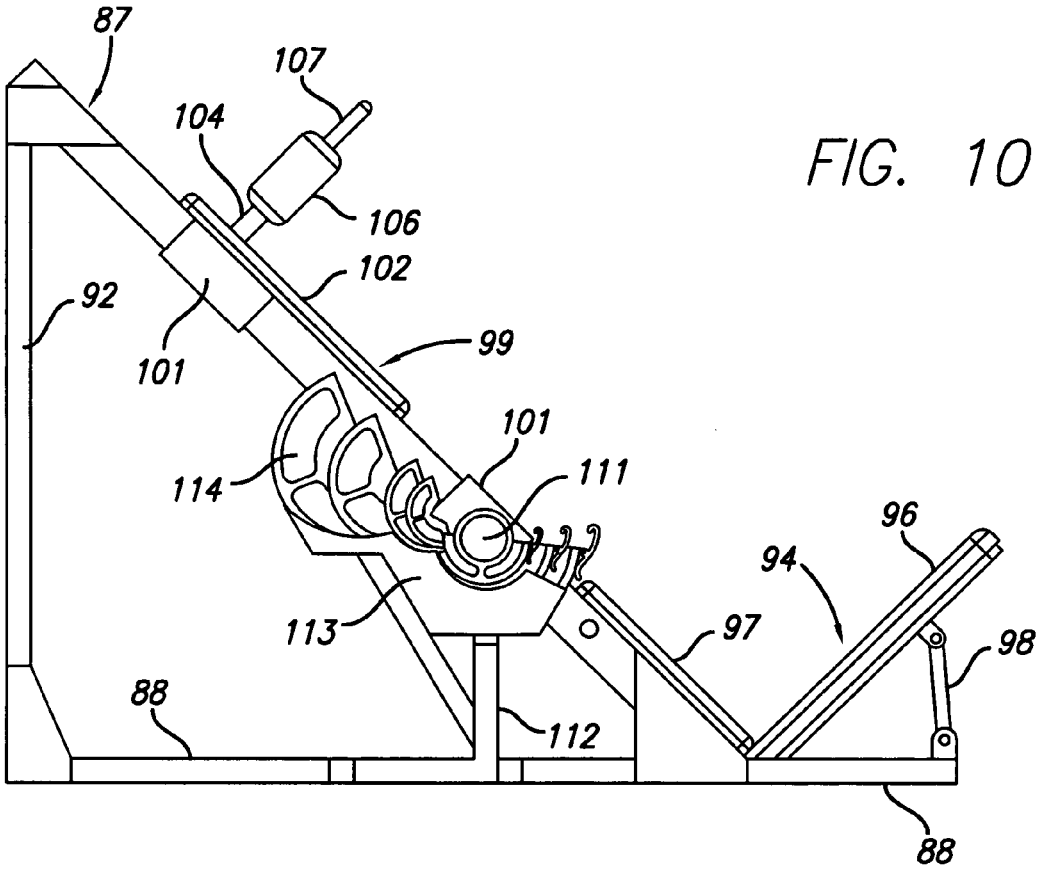
FIG. 10
FIG. 11
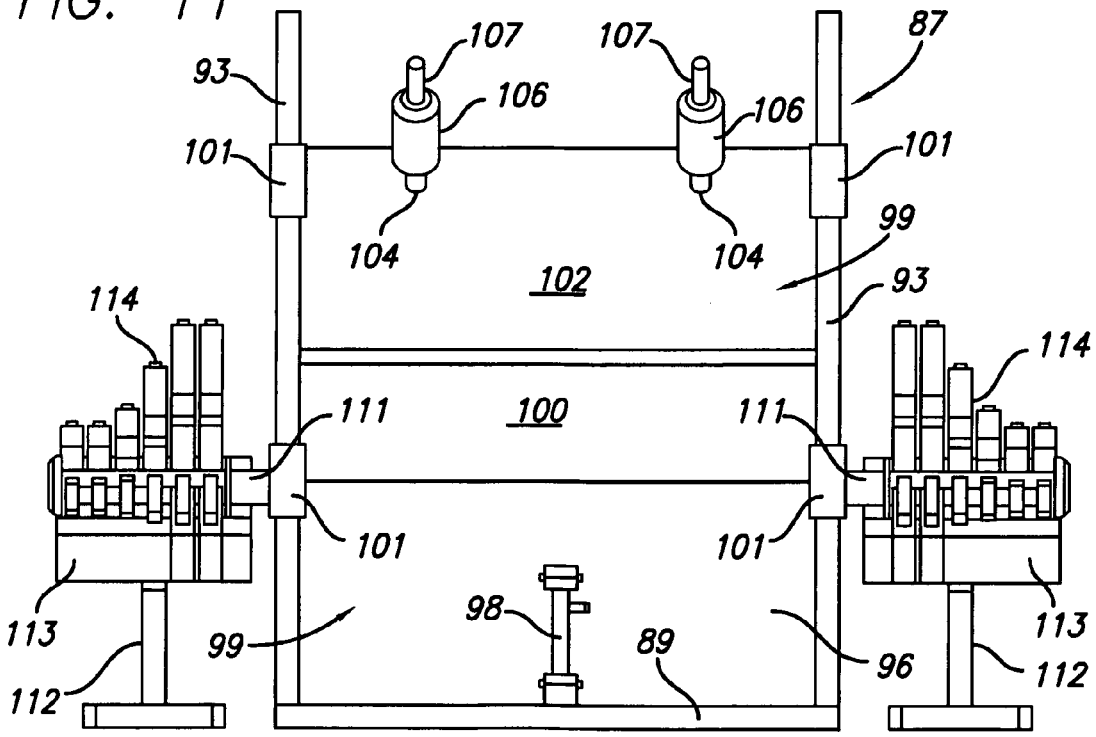

WEIGHTLIFTING SYSTEM FOR DOING LEG PRESSES

RELATED APPLICATION

This is a continuation-in-part of application Ser. No. 10/600,216, filed Jun. 19, 2003 now U.S. Pat. No. 7,018,325 B2.

BACKGROUND OF THE INVENTION

1. Field of Invention

This invention pertains generally to exercise and fitness equipment and, more particularly, to an improved weightlifting system which is particularly suitable for doing leg presses.

2. Related Art

Notwithstanding the numerous types of exercise and fitness equipment which have been developed in recent years, free weights or barbells still remain one of the most popular. Such devices typically consist of an elongated bar, a plurality of interchangeable weight plates which are mounted on the end portions of the bar, and collars which retain the weight plates in place.

Changing the weight on the bar requires removal of the outer collars, the lifting of weight plates onto and/or off of the bar, and replacement of the collars. This takes time and, in addition to being inconvenient, can be difficult for a smaller person who must remove the heavier plates left on the bar by a stronger prior user. Also, in handling weight plates, there is always a danger of personal injury or property damage if the plates are dropped or inadvertently banged together.

Another problem in the use of free weights arises when the lifter is doing exercises on a bench, with the bar above him. As the lifter does his exercise, he tends to tire, and a spotter is often required to help him lift the bar away from his body at the end of the exercise so he can get out from under it.

OBJECTS AND SUMMARY OF THE INVENTION

It is, in general, an object of the invention to provide a new and improved weightlifting system which is particularly suitable for doing leg presses.

Another object of the invention is to provide a weightlifting system of the above character which overcomes the limitations and disadvantages of systems heretofore provided.

These and other objects are achieved in accordance with the invention by providing a weightlifting system having an inclined frame, a foot support near the lower end of the inclined frame for receiving the feet of an exerciser, a carriage adapted for receiving the back of the exerciser and being driven in an upward direction along the frame by extension of the legs of the exerciser, a weight bar extending laterally from each side of the carriage, a pair of weight stands positioned to the sides of the frame, and a plurality of weight plates disposed on each of the stands for selective attachment to the bar extending from each side of the carriage.

BRIEF DESCRIPTION OF THE DRAWINGS

FIG. 10 is a side elevational view of the embodiment of FIG. 9.

FIG. 11 is a front elevational view of the embodiment of FIG. 9.

DETAILED DESCRIPTION

Figure 1:
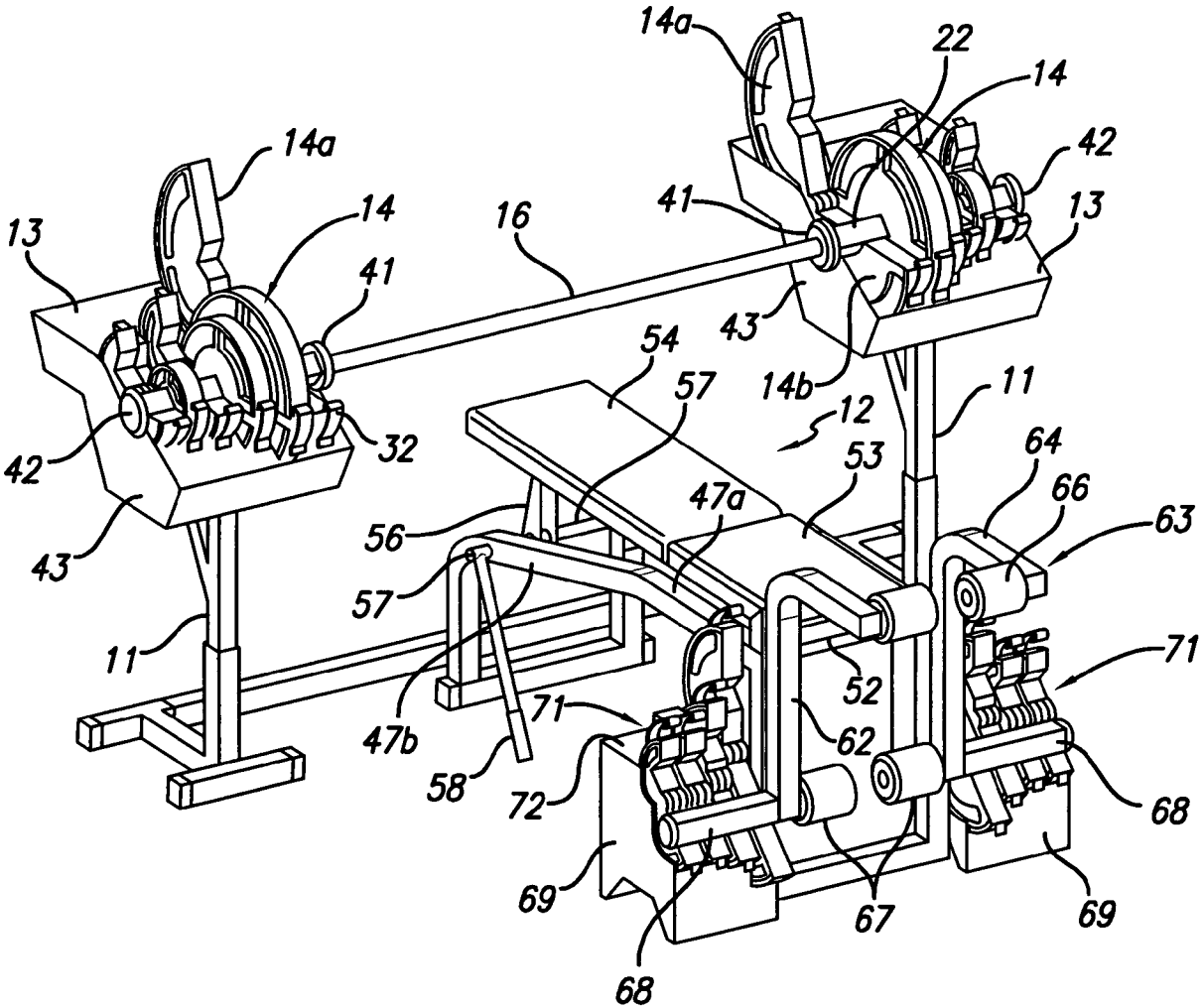
FIG. 1 is an isometric view of one embodiment of a weightlifting system incorporating the invention.

As illustrated in FIG. 1, the weightlifting system includes a pair of weight stands 11 which are positioned on opposite sides of a bench 12. A tray 13 at the top of each stand holds a plurality of weight plates 14 in an upright, side-by-side position for selective attachment to an elongated bar 16 which extends over the bench and between the stands. If desired, the weight stands can be made adjustable in height in order to adjust the rest position of the bar.

Figure 2:
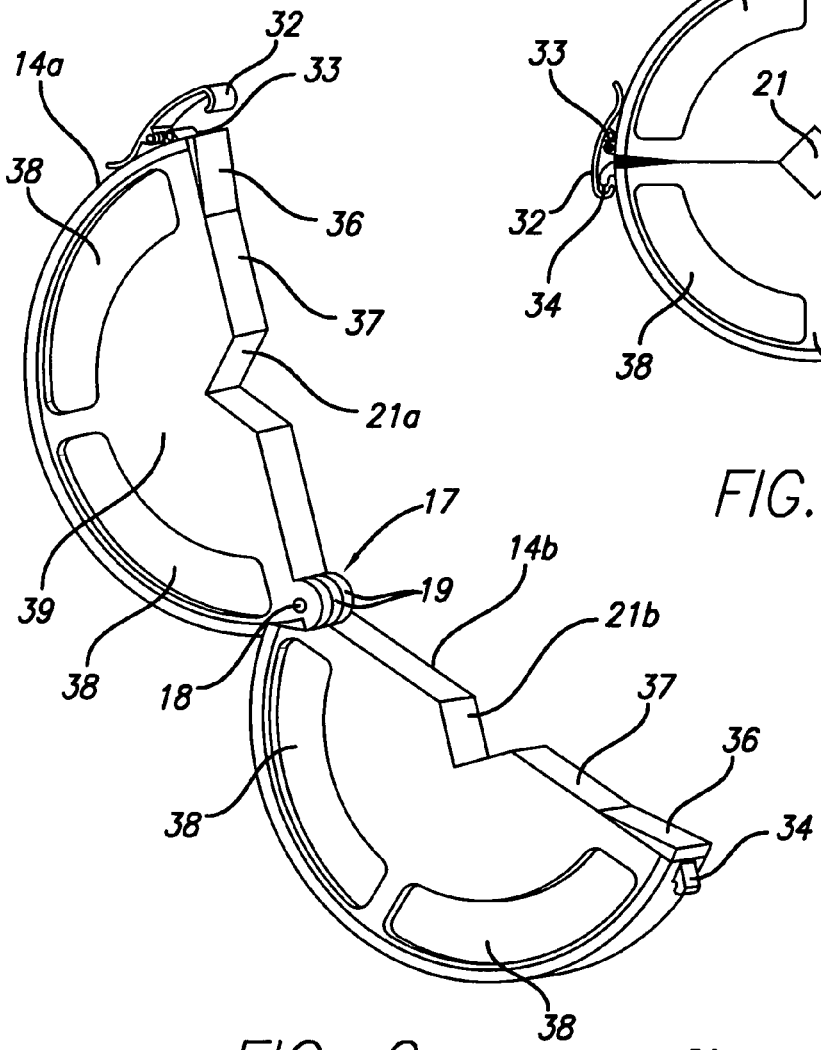
FIG. 2 is a front isometric view of one of the weight plates in the embodiment of FIG. 1 in an open position.
Figure 3:
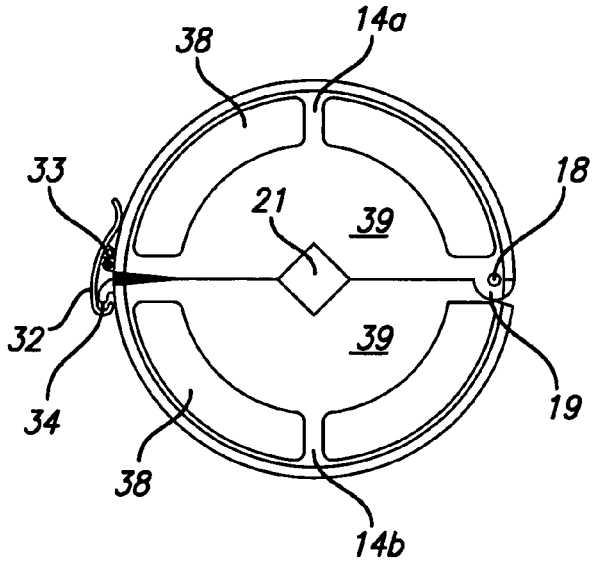
FIG. 3 is a rear elevational view of the weight plate of FIG. 2 in a closed position.
Figure 4:
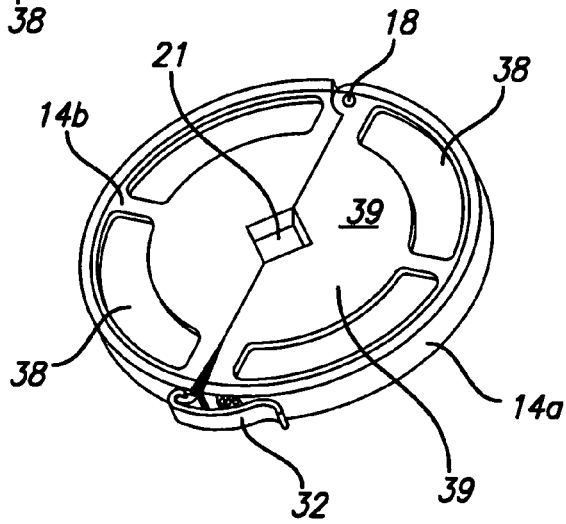
FIG. 4 is a front isometric view of the weight plate of FIG. 2 in a closed position.
Figure 5:
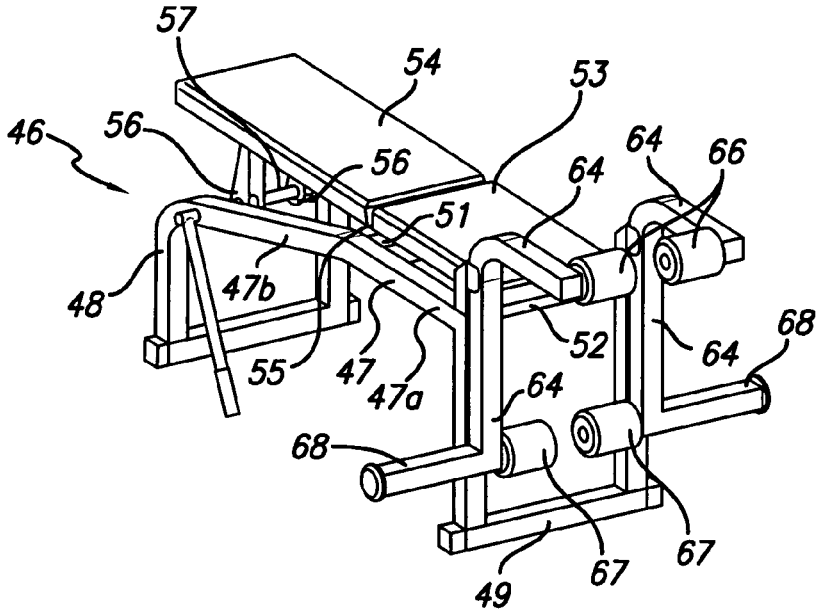
FIG. 5 is an enlarged isometric view of the adjustable bench in the embodiment of FIG. 1.

As best seen in FIGS. 2–4, each of the weight plates has two semicircular sections 14*a*, 14*b* which are hinged together at 17 for movement between open and closed positions. In the embodiment illustrated, the hinge consists of a pin 18 which passes through interleaved flanges 19 that are formed as integral parts of the plates.

Each plate has a central opening 21 through which the bar extends. The opening is formed partly in each of the two sections 14*a*, 14*b*, and when the plate is in its closed position, the walls of the opening encircle the bar. In the open position, the bar rests only in the portion 21*b* of the opening in the lower section of the plate and is free to be lifted into and out of it.

In the embodiment illustrated, both the openings 21 in the plates and the end portions 22 of the bar have a square shape, which prevents the weights from rotating on the bar and ensures that they will be oriented correctly upon return to the weight trays.

The two sections of the weight plates are held in the closed position by a clasp 32 which is mounted on one of the sections by an over-center linkage 33 and a lug 34 on the other. Resilient rubber pads 36 are mounted on the confronting edges 37 of the two sections, and arcuately extending recesses 38 are formed in the side faces 39 of the plates to facilitate handling of the plates.

Collars or flanges 41, 42 are affixed to the bar at the inner and outer ends of areas in which the weight plates are attached. In addition to preventing the plates from sliding along or falling off the bar, these flanges also serve as guides for returning the bar to the proper axial position in weight trays 13. In this regard, it will be noted that the spacing between the flanges is slightly greater than the distance between the outer surfaces 43 of the side walls of the weight trays and that the flanges are on opposite sides of the trays when the bar is in the correct axial position.

If desired, each of the weight plates can be individually retained in an axial position on the bar by a locating pin (not shown) which extends from either the weight plate or the bar and is received in the other.

Bench 12 has a supporting frame 46 with side rails 47 and legs 48, 49 at the head and foot ends of the rails. Each of the rails has a horizontal section 47*a* toward the foot of the bench and a downwardly inclined section 47*b* toward the head. Cross members 51, 52 extend between the rails at the ends of the horizontal sections.

A seat 53 is mounted in a stationary position on the horizontal section of the frame, and a backrest 54 is mounted on the inclined section for movement between raised and lowered positions. The inner end of the backrest is pivotally mounted to cross member 51 by a hinge 55, and the outer end is supported by a pair of lift arms 56. The lift arms are affixed to a shaft 57 which is rotatively mounted between the side rails of the frame. An operating handle or lever 58 is affixed to the shaft on one side of the bench and provides means for a person on the bench to raise and lower the backrest.

Figure 6:
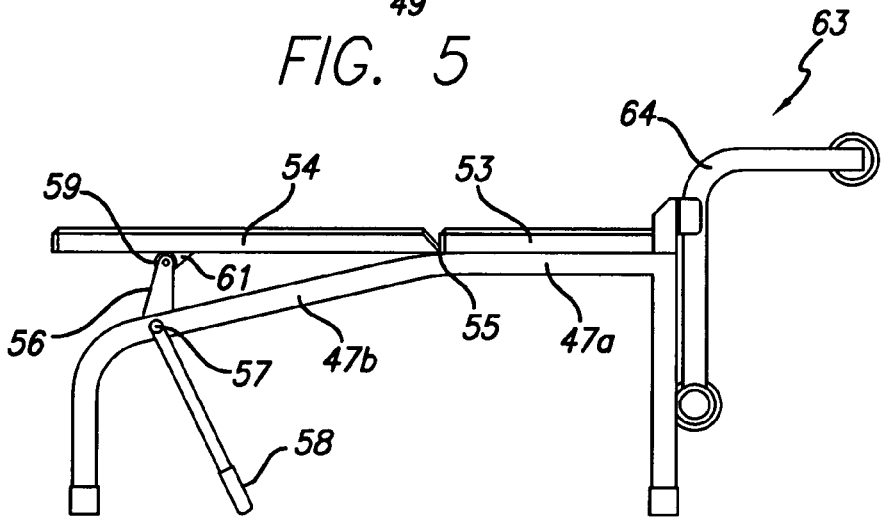
FIGS. 6 and 7 are side elevational views of the bench of FIG. 5 in raised and retracted positions.

The lift arms include rollers 59 which engage the under side of the backrest in cam-like fashion, and stops 61 on the backrest limit rotation of the arms in one direction. The backrest is brought a horizontal position by rotation of the handle in a downward direction until the rollers abut against the stops. As best seen in FIG. 6, the stops are positioned somewhat closer horizontally to the hinge than the shaft, and the arms lean back toward the stops when the backrest is in the horizontal or raised position. Consequently, the weight of the person on the bench urges the rollers against the stops and locks the backrest in the horizontal position.

Figure 7:
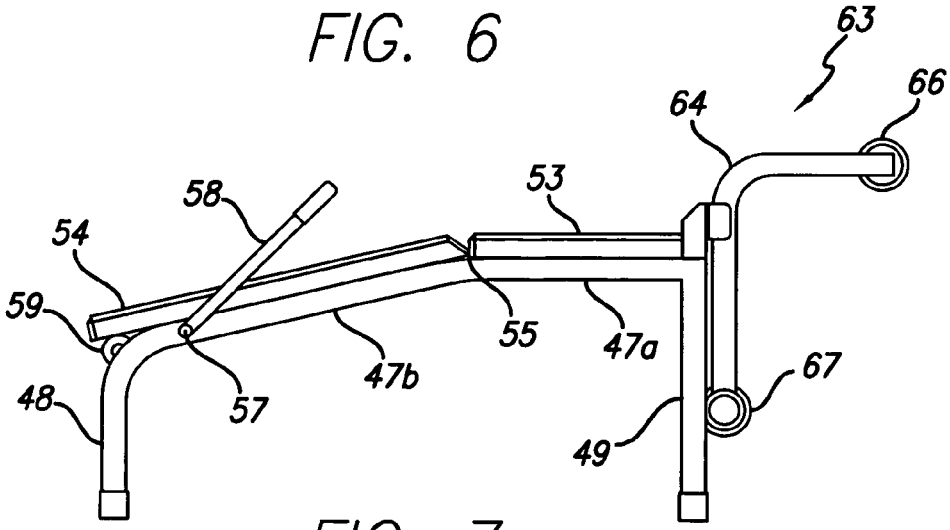

The backrest is lowered to an inclined position by rotating the handle in an upward direction as illustrated in FIG. 7. By lowering the backrest in this manner, a person can get onto and off of the bench with the bar in a relatively low position, e.g. resting on the weight stands. This makes it possible for him to do exercises such as bench presses without the help of a spotter.

A pair of individually operable leg extension bars 63 are provided at the foot of the bench. Each of these bars includes an L-shaped arm 64 which is pivotally mounted to the frame, with rollers 66, 67 extending in an inward direction at the upper and lower ends of the arms. Weight bars 68 extend in an outward direction at the lower ends of the arms in axial alignment with rollers 67.

Weight trays 69 are positioned on opposite sides of the bench near weight bars 68. Each of these trays holds a plurality of weight plates 71 in a side-by-side position for selective attachment to weight bars 68. These plates are similar to weight plates 14 and are attached to the weight bars in the same manner those plates are attached to barbell bar 16. Weight trays 69 have generally rectangular housings 72 which can also serve as footrests for a person on the bench.

Operation and use of the weightlifting system is as follows. With bar 16 resting in weight trays 13, a person wishing to do an exercise with the barbell selects the amount of weight he wants to lift by simply swinging the upper sections of the desired plates down onto the lower sections and locking them in place with clasps 32.

He can then get onto the bench, with backrest 54 in its lowered position, and position himself beneath the bar. He raises the bench to its horizontal position by pushing down on handle 58 and does his exercise. When he is done with the exercise, he returns the bar to its rest position, with the weight plates resting in the weight trays, then lifts the handle to lower the backrest so he can get out from under the bar.

For leg exercises, he attaches the desired plates 71 to each of weight bars 68 by simply swinging the upper sections of the plates down onto the lower sections and locking them in place. As noted above, the leg bars are independent of each other, and different amounts of weight can be used on the two, if desired.

To do leg extensions, a person sits on seat 53, with his upper legs over rollers 66 and his lower legs behind rollers 67, then extends and bends his legs at the knee. When he is done with the exercise, the weights will return to the trays, and because of the manner in which the plates are attached to the bars, he can change them while seated on the bench.

Figure 8:
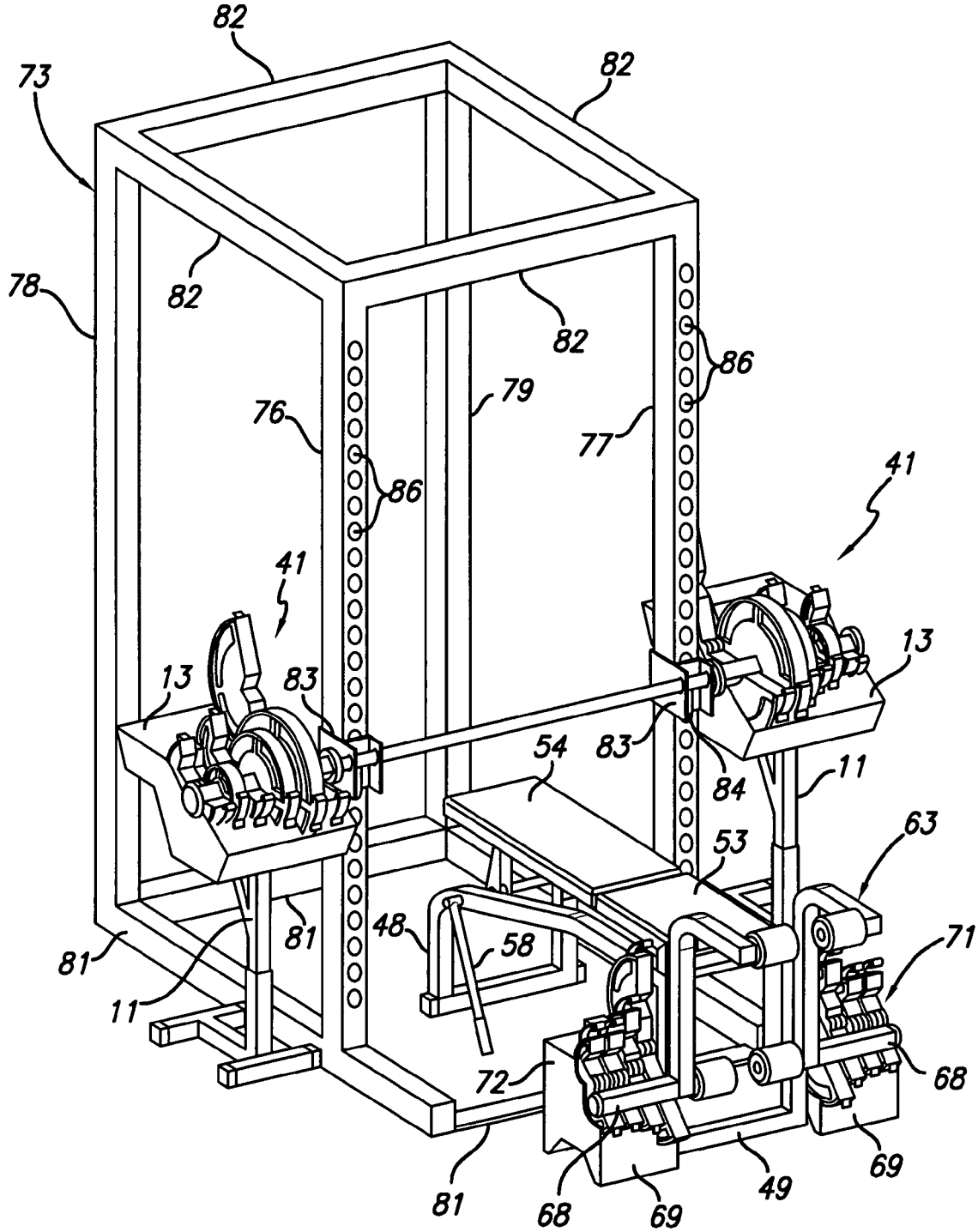
FIG. 8 is an isometric view of another embodiment of a weightlifting system incorporating the invention.

The embodiment shown in FIG. 8 is similar to the embodiment of FIG. 1, with the addition of a frame 73 which serves as a guide for the barbell. The frame has four upright members or posts 76–79 mounted on a rectangular base 81 and connected together at their upper ends by rails 82.

Guide sleeves 83 are slidably mounted on posts 76, 77 and connected to bar 16 to constrain the bar for vertical movement along the posts. In the embodiment illustrated, the bar is connected to the guides by passing the bar through aligned openings in flanges which extend rearwardly from the sleeves.

Means is provided for holding the bar in a rest position at a desired height. That means includes pins 84 which can be selectively engaged with holes 86 that spaced along the length of posts 76, 77. The pins extend from the holes, and the guide sleeves rest upon the exposed portions of the pins.

Operation and use of the embodiment of FIG. 8 is similar to that of the embodiment of FIG. 1, the only difference being the function of the guide posts and sleeves in constraining the barbell for movement in a vertical direction and in holding it at a desired rest height.

Figure 9:
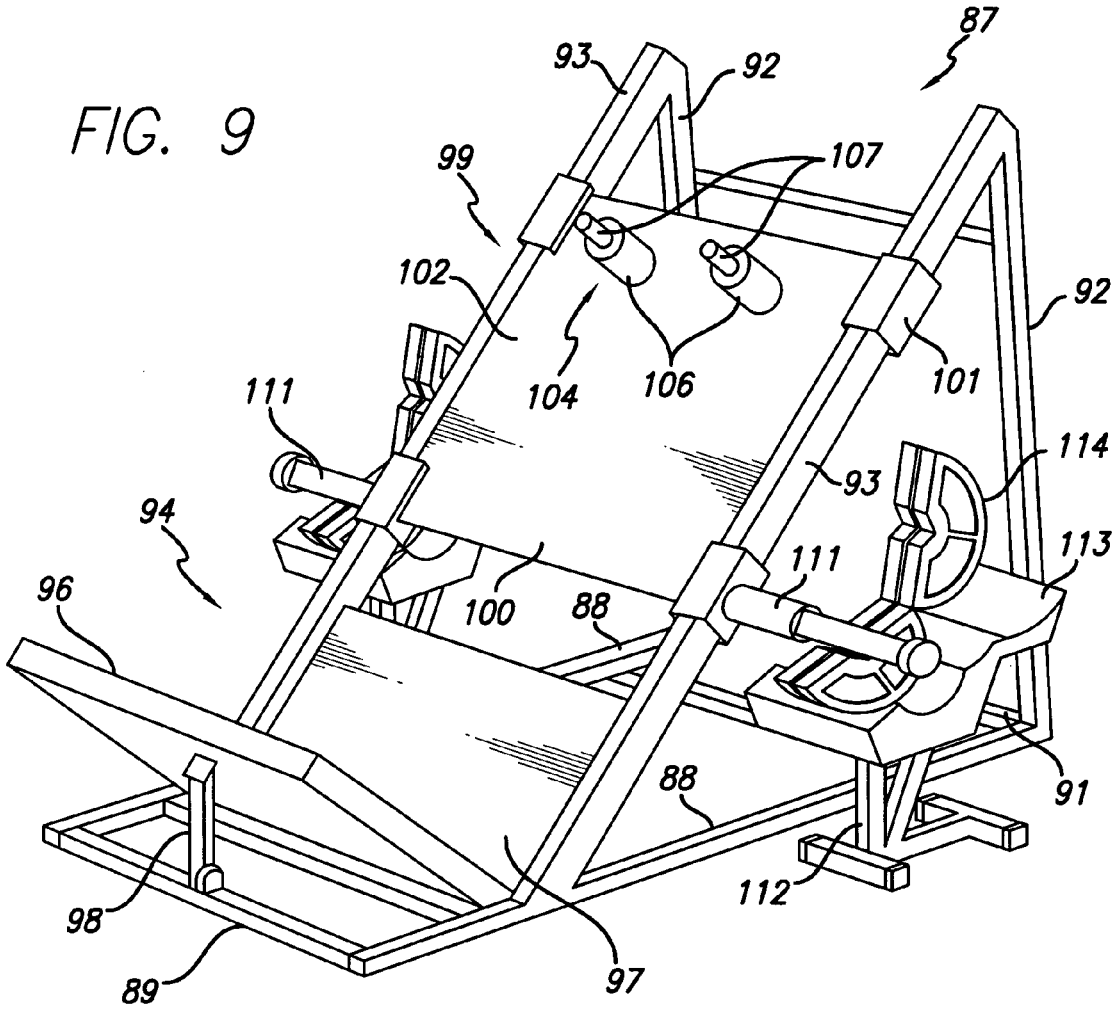
FIG. 9 is an isometric view of an embodiment of a weightlifting system incorporating the invention which is particularly suitable for use in doing leg presses.

The embodiment shown in FIG. 9 is particularly suitable for doing leg presses. It has a frame 87 with horizontally extending side rails 88, cross members 89, 91 between the side rails, upright posts 92 at one end of the side rails, and inclined rails 93 extending between the upper ends of the posts and the side rails near other end of the frame. The side rails and cross members form a base which is adapted to rest on a horizontal supporting surface, with rails 93 being inclined at an angle on the order of 45 degrees.

A footrest 94 is mounted on the frame at the lower ends of the inclined rails, with a platform 96 which extends upwardly in a direction generally perpendicular to the rails and a panel 97 which lies generally in the plane of the rails. The footrest is pivotally mounted on the base, with a prop or brace 98 mounted on cross member 89 supporting the platform in the desired position.

A carriage 99 is mounted on the inclined rails for movement along them. In the embodiment illustrated, the carriage has a base plate 100 which extends between the rails, with mounting collars 101 affixed to the plate slidably or rollably mounted on the rails. A generally rectangular cushion or pad 102 is mounted on the upper or front side of the plate to form a backrest, with a pair of relatively short posts 104 which extend in an outward direction from the backrest near the top of the carriage. Pads 106 are mounted on the inner portions of the posts for engagement by the shoulders of an exerciser whose feet are on the footrest platform and whose back is against the backrest, with the outer portions of the posts serving as grips 107 which can be grasped by the hands of the exerciser in front of his shoulders. Alternatively, the exerciser can place his back on the platform and his feet against the posts. In either position, he can drive the carriage in an upward direction by extending his legs.

A weight bar 111 extends laterally from each side of the carriage. In the embodiment illustrated, separate weight bars are provided on the two sides, and they are welded to the outer faces of the lower mounting collars. Alternatively, a single weight bar which extends all the way across the machine can be affixed to the carriage beneath the rails, with the end portions of the bar extending laterally from the two sides of the carriage.

A pair of weight stands 112 are positioned beside the frame. These weight stands are similar to weight stands 11, and each has a tray 113 with a plurality of weight plates 114 which are similar to weight plates 14. The weight stands are positioned so that when the carriage is in its lowermost or rest position, weight bars 111 are received in the openings in the plates, and the plates can be selectively attached to and detached from the bars.

Operation and use of the embodiment of FIG. 9 is as follows. With the carriage in rest position and the bars resting in the openings in the lower sections of the weight plates, the desired plates can be attached to the bars by swinging the upper sections of those plates down onto the lower sections and locking the two sections together. Similarly, plates can be removed from the bars by unlocking them and swinging the upper sections to the open position. The unused plates are left in the open position. The plates can thus be attached to and removed from the bars without having to slide them onto and off of the bars.

Figure 12:
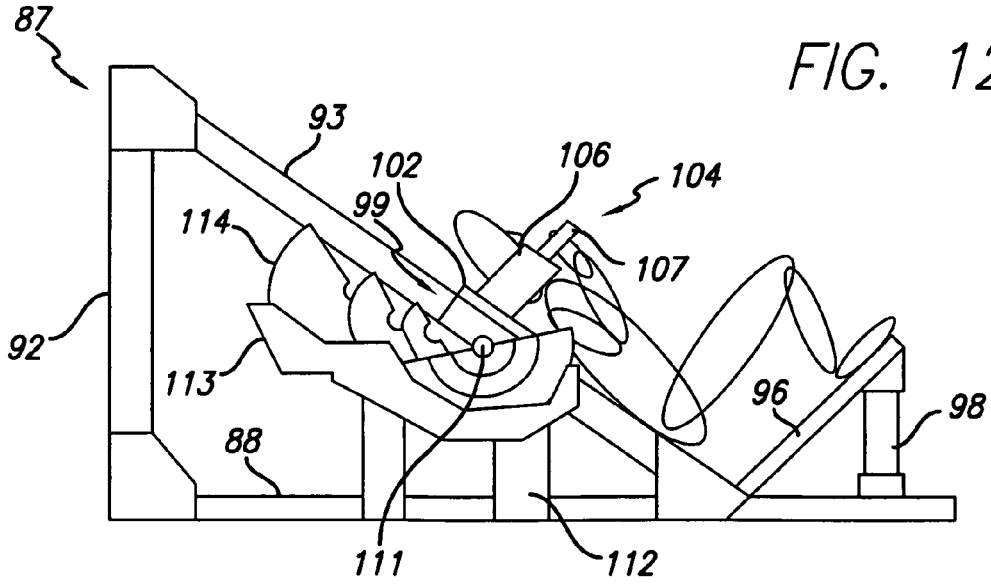
FIG. 12 is an operational view of the embodiment of FIG. 9, showing an exerciser doing leg presses with the system

To do leg presses, the exerciser can place his feet on footrest 94, with his legs bent and his back against backrest 102, as illustrated in FIG. 12. His shoulders engage the under sides of pads 106 on posts 104, and he grips handgrips 107 with his hands in front of his shoulders. When he straightens his legs, the carriage is driven in a upward direction, carrying the weight plates attached to the bars with it and leaving the others behind on the stands. When he relaxes his legs, the carriage returns to the rest position.

As noted above, the exerciser can also do leg presses by placing his back on platform 96, with his knees bent and his feet against posts 104. By alternately straightening and relaxing his legs, he can move the carriage up and down, with the plates attached to the weight bars resisting the upward movement.

It is apparent from the foregoing that a new and improved weightlifting system has been provided. While only certain presently preferred embodiments have been described in detail, as will be apparent to those familiar with the art, certain changes and modifications can be made without departing from the scope of the invention as defined by the following claims.

The invention claimed is:

1. A weightlifting system for doing leg presses, comprising:

an inclined frame, a foot support near the lower end of the inclined frame, a carriage which is movable along the inclined frame for receiving the back of an exerciser whose feet are on the foot support, means on the carriage for engagement by the exerciser so he can drive the carriage in an upward direction along the frame by extension of his legs, a weight bar extending laterally from each side of the carriage, a pair of weight stands positioned to the sides of the frame beneath the weight bars when the carriage is in a rest position, and a plurality of weight plates disposed on each of the stands in position for engaging and being selectively attached to the weight bars when the carriage is in the rest position.

2. The system of claim 1 wherein the weight plates are disposed side-by-side in an upright position on the weight stands, formed in sections which are hinged together, and adapted to be selectively attached to the bar by moving the sections between open and closed positions.

3. The system of claim 2 wherein weight plates rest on the weight stands in a normally open position.

4. The system of claim 1 wherein the means for engagement by the exerciser comprises a pair of padded abutments adapted to be engaged by the shoulders of the exerciser.

5. The system of claim 4 including handgrips which extend from the padded abutments and are adapted to be grasped by the hands of the exerciser in front of his shoulders.

6. The system of claim 1 wherein the foot support comprises a platform which extends upwardly in a direction generally perpendicular to the inclined frame.

7. A weightlifting system for doing leg presses, comprising:

a base adapted to rest off a horizontal supporting surface, a pair of upright posts toward one end of the base, an inclined frame extending downwardly between upper portions of the posts and the other end of the base, a foot support mounted on the base near the lower end of the inclined frame, a carriage which is movable along the inclined frame for receiving the back of an exerciser whose feet are on the foot support, means on the carriage for engagement by the exerciser so he can drive the carriage in an upward direction along the frame by extension of his legs, a weight bar extending laterally from each side of the carriage, a pair of weight stands positioned to the sides of the frame beneath the weight bars when the carriage is in a rest position, and a plurality of weight plates disposed on each of the stands in position for engaging and being selectively attached to the weight bars when the carriage is in the rest position.

8. The system of claim 7 wherein the weight plates are disposed side-by-side in an upright position on the weight stands, formed in sections which are hinged together, and adapted to be selectively attached to the bar by moving the sections between open and closed positions.

9. The system of claim 8 wherein weight plates rest on the weight stands in a normally open position.

10. The system of claim 7 wherein the means for engagement by the exerciser comprises a pair of padded bumpers adapted to be engaged by the shoulders of the exerciser.

11. The system of claim 10 including handgrips which extend from the padded bumpers and are adapted to be grasped by the hands of the exerciser in front of his shoulders.

12. The system of claim 7 wherein the foot support comprises a platform which extends upwardly in a direction generally perpendicular to the inclined frame.

13. A weightlifting system for doing leg presses, comprising:

an inclined frame, a foot support near the lower end of the inclined frame, a carriage which is movable along the inclined frame and has a backrest for receiving the back of an exerciser whose feet are on the foot support, a pair of padded shoulder posts with handgrips extending outwardly from the backrest for engagement by the shoulders and hands of the exerciser so he can drive the carriage in an upward direction along the frame by extension of his legs, a weight bar extending laterally from each side of the carriage, a pair of weight stands positioned to the sides of the frame beneath the weight bars when the carriage is in a rest position, and a plurality of weight plates disposed on each of the stands in position for engaging and being selectively attached to the weight bars when the carriage is in the rest position.

14. The system of claim 13 wherein the weight plates are disposed side-by-side in an upright position on the weight stands, formed in sections which are hinged together, and adapted to be selectively attached to the bar by moving the sections between open and closed positions.

15. The system of claim 14 wherein weight plates rest on the weight stands in a normally open position.

16. The system of claim 13 wherein the foot support comprises a platform which extends upwardly in a direction generally perpendicular to the inclined frame.

17. A weightlifting system for doing leg presses, comprising:

an inclined frame, a foot support near the lower end of the inclined frame for receiving the feet of an exerciser, a carriage adapted for receiving the back of the exerciser and being driven in an upward direction along the frame by extension of the legs of the exerciser, a weight bar extending laterally from each side of the carriage, a pair of weight stands positioned to the sides of the frame beneath the weight bars when the carriage is in a rest position, and a plurality of weight plates disposed on each of the stands in position for engaging and being selectively attached to the weight bars when the carriage is in the rest position.

18. The system of claim 17 wherein the weight plates are disposed side-by-side in an upright position on the weight stands, formed in sections which are hinged together, and adapted to be selectively attached to the bar by moving the sections between open and closed positions.

19. The system of claim 17 wherein weight plates rest on the weight stands in a normally open position.

* * * * *